US006213816B1

(12) United States Patent
Meichsner et al.

(10) Patent No.: US 6,213,816 B1
(45) Date of Patent: Apr. 10, 2001

(54) LAMP SOCKET FOR MULTIPIN LAMPS

(75) Inventors: Manfred Meichsner, Kierspe; Dirk Böhme, Meinerzhagen, both of (DE)

(73) Assignee: Bender & Wirth GmbH & Co., Kierspe (DE)

( * ) Notice: Subject to any disclaimer, the term of this patent is extended or adjusted under 35 U.S.C. 154(b) by 0 days.

(21) Appl. No.: 09/421,669

(22) Filed: Oct. 20, 1999

(30) Foreign Application Priority Data

Apr. 14, 1999 (DE) ..... 299 06 559

(51) Int. Cl.[7] ..... H01R 24/00; H01R 11/20; H01R 4/24; H01R 4/26; H01R 13/627

(52) U.S. Cl. ..... 439/699.2; 439/414; 439/336; 439/356; 439/280; 439/683

(58) Field of Search ..... 439/414, 356, 439/336, 280, 619, 817, 683, 699.2, 699.1, 660, 607, 819, 701, 246

(56) References Cited

U.S. PATENT DOCUMENTS 4,941,836 * 7/1990 Bormuth ..... 439/247
5,376,025 * 12/1994 Willnat et al. ..... 439/817
5,547,402 * 8/1996 Ogawa ..... 439/699.2
5,720,544 * 2/1998 Shu ..... 362/226
5,743,757 * 4/1998 Chen ..... 439/419

* cited by examiner

*Primary Examiner*—Paula Bradley
*Assistant Examiner*—Edwin A. León
(74) *Attorney, Agent, or Firm*—Friedrich Kueffner

(57) ABSTRACT

A lamp socket for multipin lamps with spring-biased contacts for contacting the contact pins of a lamp, and a housing which in the final assembly state at least partially surrounds the lamp base of the lamp. The housing is composed of an upper housing part which supports a device for aligning and securing the lamp, and a bottom hosing part which supports at least indirectly receiving means for the contacts. The spring-biased contacts provided for contacting the various contact pins are arranged in individual electrically insulating and housing-like contact cages which are moveable independently of each other.

24 Claims, 3 Drawing Sheets

LAMP SOCKET FOR MULTIPIN LAMPS

BACKGROUND OF THE INVENTION

1. Field of the Invention

The invention relates to a lamp socket or holder for multipin lamps with spring-biased contacts for contacting the contact pins of a lamp, and a housing which in the final assembly state at least partially surrounds the lamp base of the lamp, wherein the housing is composed of an upper housing part which supports a device for aligning and securing the lamp, and a bottom hosing part which supports at least indirectly receiving means for the contacts.

2. Description of the Related Art

Lamp sockets of the above-described type are frequently used for securing and electrically contacting lamps in various lighting devices. In addition to the lamp and socket, these lighting devices frequently also include reflecting and/or refracting optical systems of various complexity which are optimized for the respective purpose of use. It is of particular importance in this connection that the actual incandescent filament is positioned in a well defined spatial relationship relative to the surrounding optical system. In a predominant number of cases, a manual adjustment of the incandescent filament and/or the optical system adapted to each individual case is not possible. Rather, most manufacturers construct the lamps in such a way that the incandescent filament has a precisely specified alignment relative to a contact surface or contact line at the lamp base. Consequently, the sockets which are usually fixed relative to the optical lighting system have in most cases a corresponding reference surface whose purpose it is to ensure an automatic alignment of the lamp, for example, by biasing the lamp base relative to the reference surface by a spring.

However, a more fundamental purpose of the lamp socket is to provide a secure electrical contact of the contact pins which must be ensured even at high temperatures and after frequent replacements of the lamp.

In order to meet this object, various solutions have been proposed. Sockets are known in the art which, among other features, include a ceramic bottom housing part which is provided with recesses for inserting the contact pins. One of these recesses is usually tapered in the shape of a prism, wherein a spring-biased contact plate is arranged opposite the prism-shaped taper so that the inserted contact pin is pressed by the contact plate into the prism-shaped groove and the contact pin is secured relative to the bottom housing part as a result. Additional contact pins are secured in a similar manner, wherein, however, manufacturing tolerances must frequently be taken into consideration by providing the recesses with the shape of oblong holes.

However, this results in the decisive disadvantage that two pairs of reference are defined, i.e., the lamp base and the upper housing part, on the one hand, and the contact pin and the upper housing part, on the other hand, wherein the relative alignment of the contact surface or line at the lamp base relative to those at the contact pins is not specified and is usually subject to significant manufacturing tolerances. At which pair of reference the alignment actually takes place depends essentially on the dimensioning of the spring forces which, however, may also be subject to variations due to temperature changes.

Another disadvantage is the fact that, when the alignment takes place at the contact surface provided by the lamp manufacturer, contacting of the contact pins can only be optimized in exceptional cases. Especially in the case of higher temperatures, this results in contacting problems which significantly reduces the reliability of the entire lighting device.

A contacting device which is supposed to eliminate this disadvantage is disclosed in DE 295 19 948.2. In that case, the contact is provided by two shaped parts which engage in each other in an articulated manner, wherein the shaped parts form together a receiving means for a contact pin on one side of the point of engagement between the shaped parts, and wherein the shaped parts include a helical spring on the other side of the point of engagement, and wherein the helical spring produces a resilient force acting against the expansion of the receiving means as a result of the insertion of the contact pin. The entire contact unit is movably mounted in a plane extending perpendicularly of the desired position of the contact pins, so that the position of the contacts can adapt to the respective position of the contact pins. No force acts on the lamp base proper, so that a defined alignment at the contact surface of the lamp base and the corresponding reference surface of the lamp socket becomes possible. However, this device has the disadvantage that the contacts are complicated and expensive to manufacture, and that there is no possibility for an adjustment to contact pins which are in an inclined position. Moreover, the contacts must be manufactured of an electrically conductive material, which makes it necessary that the contacts are embedded in a ceramic socket base; because of the moveable support, the socket base must be constructed of two parts which results in additional costs.

In accordance with another solution known in the art, individual contacts are provided for each contact pin, wherein the contacts have a cylindrical shape which corresponds to the contact pins. The contacts are manufactured from a base plate with several tongues, wherein the tongues are bent perpendicularly relative to the base plate and are at their upper ends connected to a spring ring. This results in a cup-shaped structure which is inserted in a ceramic housing base, wherein a contact pin each is placed in the cup-shaped structure. However, this solution has significant disadvantages. The diameter of the opening of the contact cup can be expanded elastically only to a minimal extent, so that the sometimes significant tolerances in the diameters of the contact pins can be compensated only insufficiently. Consequently, particularly in the case of high temperatures, incorrect contacting frequently occurs. Moreover, only a restricted mobility of the contact cups relative to the ceramic socket base can be realized because the contact pin must be inserted very precisely into the opening of the cup in order to ensure that the contact pin does not slide next to the cup and destroys it. This results in an insufficient positional alignment of the contacts relative to the contact pins. Finally, it is also in this solution absolutely necessary to provide an electrically insulating housing base with guide means for the contact pins, so that particularly inclined positions of the contact pins can be compensated only insufficiently.

SUMMARY OF THE INVENTION

Therefore, it is the primary object of the present invention to provide a socket of the above-described type which, on the one hand, ensures a reliable contacting of the contact pins and, on the other hand, facilitates an alignment of the lamp exclusively at the contact surface provided at the lamp base, wherein the inexpensive manufacture is of particular significance. Another object, which is of less significance and concerns especially the aspect of the inexpensive manufacture, is to provide a modular construction of the contacts which facilitates the use in sockets of different shapes and/or materials and which especially also provides a greater freedom of the design of the socket.

In accordance with the present invention, the spring-biased contacts provided for contacting the various contact pins are arranged in individual electrically insulating and housing-like contact cages which are moveable independently of each other.

As a result of the configuration according to the present invention, a single spring-biased contact is provided for each contact pin of the lamp to be contacted. The contact is arranged in an electrically insulated, preferably ceramic, contact cage. This contact cage is essentially freely moveable relative to all other units of the socket which includes translatory movements along all spatial axes and partial rotations about the axes. Because of the positional adjustment of the contact cages relative to the contact pins, the contact pins are contacted by spring-biased contact plates always parallel to the contact pins which ensures an optimum contacting. Preferably, each contact pin is inserted into a prism-shaped recess of the contact cage, so that the secure support of the contact cage and the contact of the contact pin are further improved. The contact plates are preferably pressed against the contact pin by a helical spring. This results in a spring range which is especially long, so that a safe contacting is also ensured in the case of higher temperatures.

Another advantage of the socket according to the present invention is the fact that it is possible to use a lower housing part of particularly simple construction. Since the insulation between the contacts and relative to the housing is already for the most part ensured by the electrically insulating contact cages, it is only necessary to provide in the lower housing part a sufficiently large space for receiving all contact cages. A particular spatial and/or electrical separation is not required. In particular, this results in the possibility of manufacturing the lower housing part at least partially of metal materials which may provide advantages with respect to carrying of heat and the design of the socket.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

DESCRIPTION OF THE PREFERRED EMBODIMENTS

Figure 1:
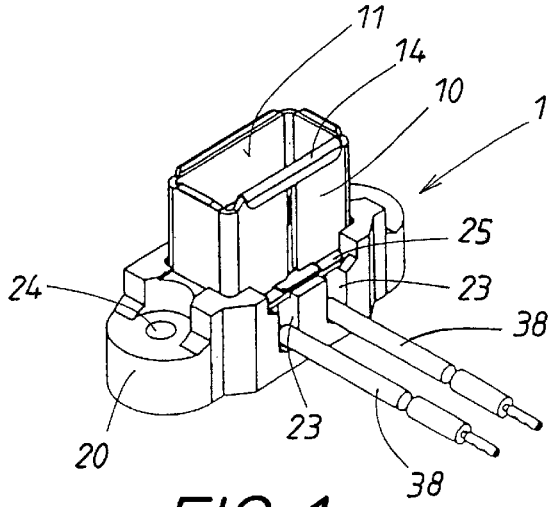
FIG. 1 is a perspective view of the lamp socket according to the present invention.
Figure 3:
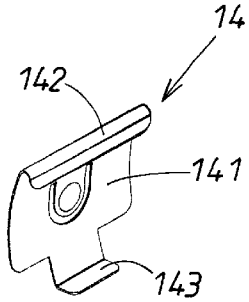
FIG. 3 is a perspective view of a spring element for pressing the contact surface of the lamp base against the reference surface of the upper housing part.
Figure 2:
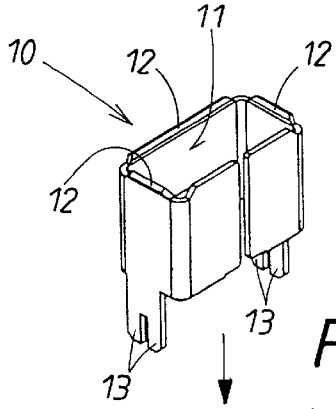
FIG. 2 is a perspective view of the upper housing part of the socket of FIG. 1.

In the embodiment of the present invention shown in the drawings, the socket 1 is composed of an upper housing part 10 and a ceramic lower housing part 20. The lower housing part 20 has a space 22 for receiving the contact cages 30. The upper housing part 10 which is preferably made of nickel-plated sheet steel, is particularly distinguished by the presence of a reference surface, wherein, in the final assembly state, the contact surface 44 of a lamp base 43 of a lamp 40 comes to rest against the reference surface 11. The lamp 40 to be mounted on the lamp base 43 further includes a glass bulb 41, an incandescent filament 42 and contact pins 45 protruding from the lamp base.

In order to ensure an automatic and secure alignment when the lamp 40 is inserted into the socket 1, a spring element 14 is provided in the upper housing part 10; in the illustrated embodiment, the spring element 14 is a plate spring. The spring element 14 is composed of the actual spring body 141 to which an upper fastening edge 142 and a lower fastening edge 143 are integrally connected. The fastening edges 142, 143 at least partially engage behind the upper and lower edges of the upper housing part 10 located opposite the reference surface 11. In this manner, the spring element 14 is pretensioned. When the lamp 40 is inserted, the contact surface 44 of the lamp base 43 is pressed against the reference surface 11 of the upper housing part 10, so that the incandescent filament 42 is automatically aligned relative to the optical system of the lighting device.

In accordance with a preferred feature, in order to ensure a simpler insertion of the lamp base 43 into the upper housing part 10, the portions of the upper edges 12 of the upper housing part 10 which are not engaged by the upper fastening edge 142 of the spring element 14 are bent outwardly at an angle. The material of the upper housing part 10, i.e., nickel-plated sheet steel, is selected for the same reason because this material has particularly smooth surface which facilitates a simple insertion of the lamp socket 43. In addition, it is possible to very inexpensively manufacture punched and bent components of sheet steel.

In accordance with the present invention, the lower housing part 20 has essentially two functions, i.e., supporting the upper housing part 10 and receiving the contact cages 30. In the embodiment illustrated in the drawings, the lower housing part 20 additionally has the purpose of securing the entire socket 1 in the lighting device. For this purpose, guide means 24 for fastening means are provided in the lower housing part 20.

The contact cages 30 are received in the recess of the lower housing part 20 provided for this purpose. In accordance with the invention, the size of the recess is selected such that the contact cages 30 remain sufficiently moveable and the contact cages 30 can completely adjust their position relative to the contact pins 45. The lower housing part has additional recesses 23 for receiving the electric leads 38.

Figure 6:
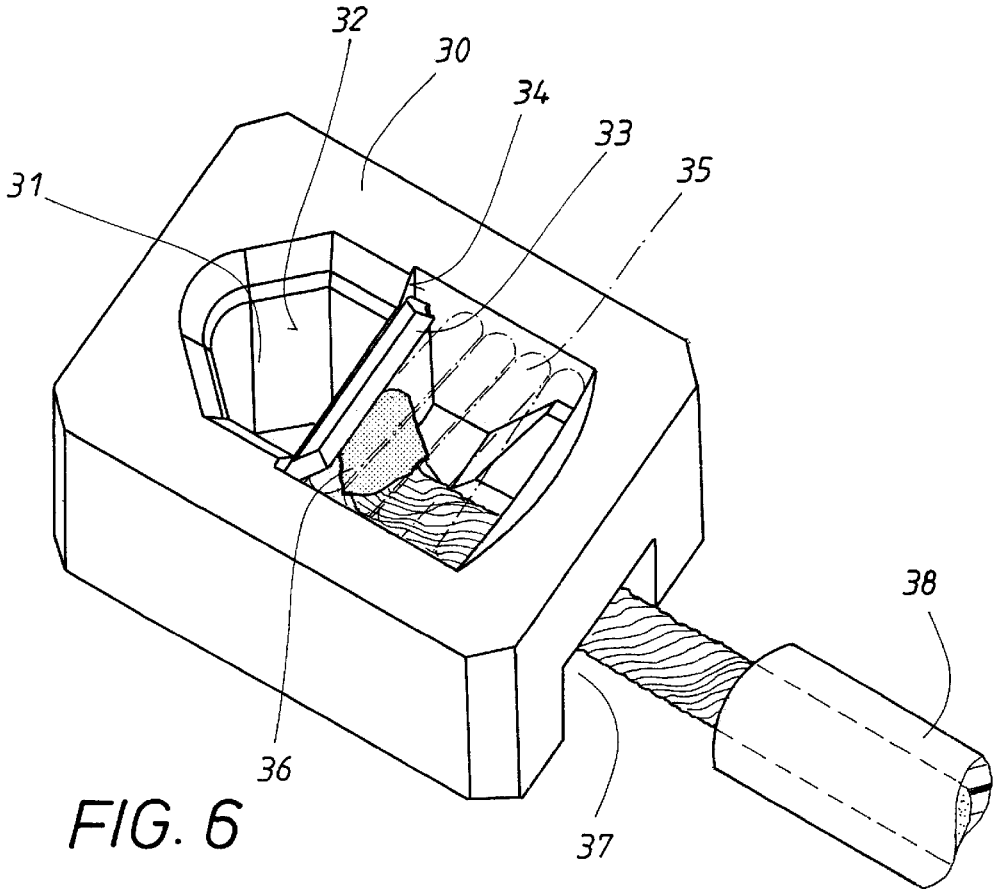
FIG. 6 is a perspective view, on a larger scale, of a contact cage with spring-biased contact and lead.
Figure 7:
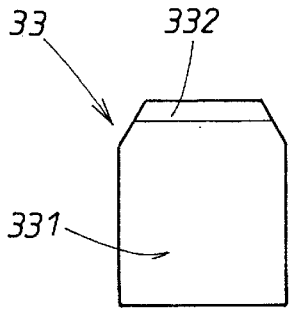
FIG. 7 is a front view of a contact plate.

FIG. 6 of the drawing shows a contact cage 30 according to the present invention as a detail. The contact cage 30 is manufactured of an electrically insulating material, preferably ceramic material. The contact cage 30 has a recess 31 for receiving a contact pin. The recess can be realized particularly advantageously as a breakthrough. The recess 31 can be divided into two portions. A first portion, which is preferably constructed so as to be unilaterally prism-shaped 32, serves for actually receiving the contact pin 45. This first portion is separated from a second portion of the recess 31 by a contact plate 33. The second portion of the recess 31 provides space for an electric lead 38 connected to the contact plate 33, preferably by welding 36, and for a helical spring 35 which is pretensioned and rests against the wall of the recess 31, on the one hand, and against the contact plate 33, on the other hand. As a result, when the contact pin 45 is not yet inserted, the contact plate 33 is pressed against a projection 34 serving as a guide means and is held in its position.

The first portion of the recess 31 must be dimensioned in such a way that an insertion of the contact pin 45 is possible only in such a manner that the contact plate 33 is displaced against the force of the helical spring 35. As a result of the prism-like shape of the recess 31, the entire contact cage 30 can be aligned relative to the contact pin 45 in such a way that the contact plate 33 rests against the contact pin 45 always parallel, i.e., with a maximum contact of its contact surface 331. The long spring range provided by the helical spring 35 ensures that a sufficient contact pressure is always ensured even at higher temperatures.

Figure 8:
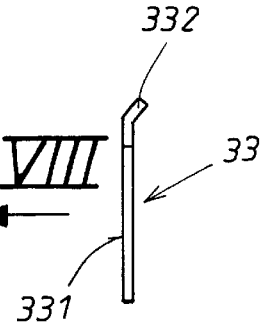
FIG. 8 is a side view of a contact plate.
Figure 9:
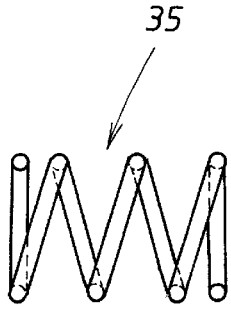
FIG. 9 is a side view of a helical spring for resiliently biasing the contact plate of FIGS. 7 and 8, as shown in FIG. 6.
Figure 10:
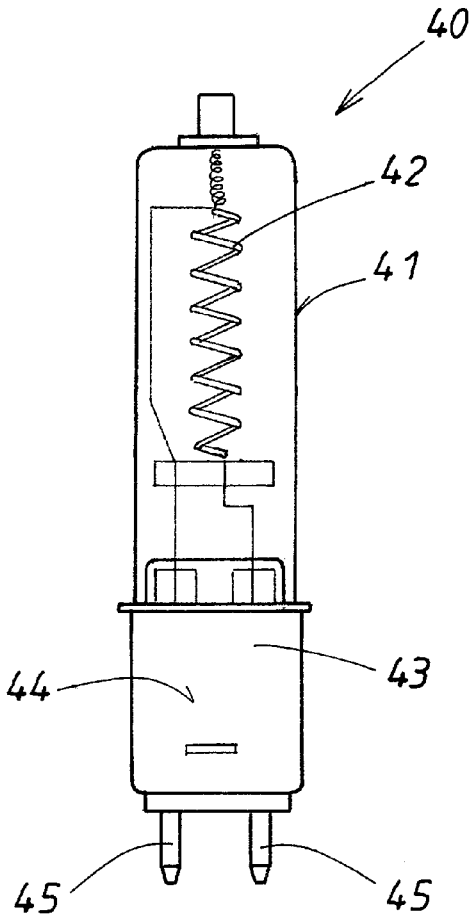
FIG. 10 is a front view of a lamp for assembly in the socket according to the present invention.
Figure 11:
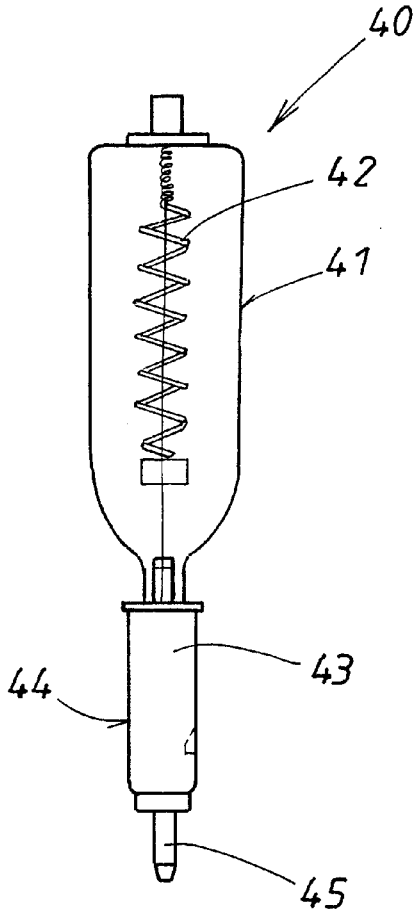
FIG. 11 is a side view of the lamp of FIG. 10.

In order to facilitate an easier insertion of the contact pins 45 into the recess 31 provided for this purpose, the upper edges of the first portion of the recess 31 are preferably bevelled. Also, as illustrated in FIGS. 6 and 8, the upper edge 332 of the contact plate 32 are bent outwardly at an angle. The contact plate 32 is preferably manufactured of a temperature-resistant contact material. The outwardly bent upper edge 332 provides the additional advantage that the helical spring 35 is secured against ejection. In accordance with an advantageous feature, the contact cage has a special recess 37 for allowing the electric lead to extend therethrough.

A variety of other configurations of the contact cage 30 are conceivable. For example, the contact cage 30 may be provided with more electrical insulation toward all sides than is the case in the embodiment shown in the drawings.

Figure 4:
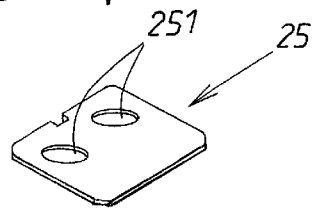
FIG. 4 is a perspective view of an insulating intermediate layer.
Figure 5:
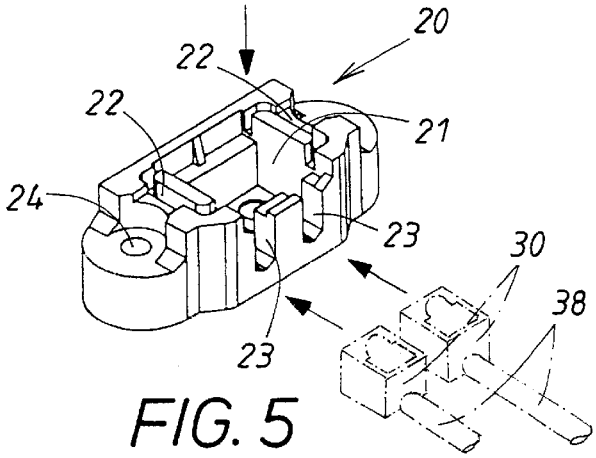
FIG. 5 is a perspective view of the lower housing part with contact cages shown next to the lower housing part.

For example, in the embodiment illustrated in the drawings, the electric insulation of the contact plate 33 and the helical spring 35 relative to the upper housing part 10 of metal is realized by the electrically insulating intermediate layer 25 shown in FIG. 4. It is important that the openings 251 in the intermediate layer 25 are significantly greater than the diameter of the contact pins 45 to be inserted. If this were not the case, the contact pins 45, for example, when they are in an inclined position, could be held by a component which is rigidly connected to the lower housing part 20; this would be contrary to the basic concept of the basic invention, namely the exclusive alignment of the lamp by means of the contact and reference surfaces.

The illustrated embodiment includes additional advantageous details which will be discussed below. The upper housing part 10 is provided with fastening legs 13 which, when the socket 1 is mounted, are inserted into corresponding slots 22 of the lower housing part 20. The slots 22 preferably extend through the entire lower housing part 20 and continue at the bottom side in a recess having a greater width, so that the upper housing part 10 can be secured to the lower housing part 20 by staggering the fastening legs 13 relative to each other.

In addition, the outer edges of the contact cages 30 are bevelled, so that the contact cages 30 are prevented from being wedged against each other; this would be harmful to the individual alignment of each contact cage 30 in accordance with the specific location of the corresponding contact pin 45.

Of course, additional modifications of the socket according to the present invention, not shown in the drawing, are possible. Some of the possible variations are described in the following. The upper and lower housing parts 10 and 20 do not necessarily have to be constructed as two parts. A single-piece construction of the housing of metal material is conceivable if, for example, by the use of a cover and a base plate at the contact cages, it is ensured that the current-conducting components are completely insulated. This may be advantageous particularly with respect to carrying of heat. If the housing is constructed of two components, various other geometrical configurations are possible. In particular, the ceramic lower part 20 could be at least partially surrounded by the upper part 10. Spring elements 14 other than plate springs could be used for aligning the lamp base 43 with its contact surface 44 at the reference surface 11 of the upper housing part 10. It is especially also conceivable to construct the reference surface 11 as a resilient structure, so that the lamp base 43 is spring-biased and secured from both sides. Moreover, the combination of contact plate 33 and helical spring 35 of the contact cages 30 could be replaced by a contact plate 33 constructed as a plate spring. Also, various possibilities are available for connecting the electric lead 38 to the contact plate 33. Of course, embodiments of lamps 40 with more than two pins 45 are conceivable, wherein especially the shape and size of the pins 45 can be essentially freely elected. Consequently, the socket 1 illustrated in the drawing is intended only as an example and the invention is not limited to this embodiment.

While specific embodiments of the invention have been described in detail to illustrate the inventive principles, it will be understood that the invention may be embodied otherwise without departing from such principles.

We claim:

1. A lamp socket for multipin lamps, the socket comprising spring-biased contacts adapted for contacting contact pins of a lamp, and a housing adapted to at least partially surround a lamp base of the lamp in a final assembly state, the housing comprising an upper housing part with means adapted for aligning and securing the lamp, and a lower housing part with receiving means for at least indirectly receiving the contacts, further comprising individual electrically insulating housing-like contact cages mounted so as to be moveable independently of each other in the receiving means, wherein the spring-biased contacts adapted for contacting the contact pins are mounted in the contact cages, wherein each contact is comprised of a contact plate and spring means for pressing the contact plate in the final assembly state against a contact pin inserted into the recess, and wherein the contact plate extends essentially parallel to the contact pin, so that the contact cages are positionally adjusted by the contact pins when the contact pins are inserted into the contact cages.

2. The socket according to claim 1, wherein the contact cages are of ceramic material.

3. The socket according to claim 1, wherein the spring means is a helical spring.

4. The socket according to claim 1, wherein the contact cage has a projection for guiding the contact plate, such that, when no contact pin is inserted into the recess, a defined minimum distance is maintained between the contact plate and an opposite side of the recess.

5. The socket according to claim 1, wherein the contact plate has a bevelled upper edge.

6. The socket according to claim 1, comprising a welded connection between each contact plate and an electric lead.

7. The socket according to claim 1, wherein each contact cage has a unilateral recess for receiving an electric lead.

8. The socket according to claim 1, wherein the contact cages are movably supported in at least one recess of the lower housing part.

9. The socket according to claim 1, further comprising an electrically insulating intermediate layer for separating the contact cages from the upper housing part.

10. The socket according to claim 1, wherein upper edges of the upper housing part are outwardly bevelled.

11. The socket according to claim 1, wherein the lower housing part is of a ceramic material.

12. The socket according to claim 1, wherein the lower housing part is at least partially of a metal material.

13. The socket according to claim 1, wherein each contact cage comprises a recess adapted for receiving a contact pin.

14. The socket according to claim 13, wherein the recess is unilaterally prism-shaped.

15. The socket according to claim 13, wherein the recess is a breakthrough of the contact cage.

16. The socket according to claim 1, wherein the upper housing part has a reference surface for a contact surface of the lamp base.

17. The socket according to claim 16, wherein the upper housing part comprises spring means for pressing the lamp base in the final assembly state against the reference surface.

18. The socket according to claim 17, wherein the spring means comprises a plate spring, wherein the plate spring engages at least partially at least one of an upper edge and a lower edge of a side of the upper housing part.

19. The socket according to claim 18, wherein the reference surfaces is constructed resiliently.

20. The socket according to claim 1, wherein the upper housing part is of sheet steel.

21. The socket according to claim 20, wherein the upper housing part is of nickel-plated sheet steel.

22. The socket according to claim 1, wherein the upper housing part has fastening legs at a lower edge thereof and the lower housing part has slots for receiving the fastening legs.

23. The socket according to claim 22, wherein the upper housing part is secured to the lower housing part by staggering the fastening legs.

24. The socket according to claim 22, wherein the lower housing part has recesses for receiving electric leads.

* * * * *